US006089324A

United States Patent [19]

Mahrt

[11] Patent Number: 6,089,324

[45] Date of Patent: Jul. 18, 2000

[54] COLD COMPRESSED AIR FOAM FIRE CONTROL APPARATUS

[76] Inventor: David M. Mahrt, 4401 Indian Ave., Redding, Calif. 96003

[21] Appl. No.: 09/270,306

[22] Filed: Mar. 15, 1999

Related U.S. Application Data

[63] Continuation of application No. 08/896,798, Jul. 18, 1997, Pat. No. 5,881,817.

[51] Int. Cl.[7] ..... A62C 35/00

[52] U.S. Cl. ..... 169/15; 169/14; 239/433

[58] Field of Search ..... 169/14, 15; 239/433

[56] References Cited

U.S. PATENT DOCUMENTS 5,623,995 4/1997 Smagac .

5,632,338 5/1997 Hunter .

5,645,223 7/1997 Hull et al. .

*Primary Examiner*—Kevin Shaver

*Assistant Examiner*—David Deal

*Attorney, Agent, or Firm*—John P. O'Banion

[57] ABSTRACT

A portable fire suppression system which uses cold compressed air foam to extinguish fires. A solution suitable for generating foam is mixed with air in an expansion manifold where the foam is supercharged and expands up to 40 times original volume. The foam is discharged out a nozzle controlled by a charge valve which controls flow rate and moisture content of the foam. The fire suppression system is mounted on a compact sturdy frame capable of withstanding parachute drops to remote sites, and includes a frame with a hitch and wheels for ground mobility.

14 Claims, 3 Drawing Sheets

COLD COMPRESSED AIR FOAM FIRE CONTROL APPARATUS

CROSS-REFERENCE TO RELATED APPLICATIONS

This application is a continuation of copending application Ser. No. 08/896,798 filed on Jul. 18, 1997, now U.S. Pat. No. 5,881,817.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to fire suppression systems, and more particularly to a portable cold compressed air foam producing system.

2. Description of the Background Art

Fires do not occur very often in aviation operations but, when they do, such fires have the potential to become deadly very quickly. In recent years, the National Guard Aviation has approached new thresholds of exposure to loss of life and high dollar losses of military equipment. The National Guard now has the latest generation of military equipment, and most National Guard combat units train for combat anywhere on short notice. This increased tempo of training requires managing risk at a higher exposure level to ensure that soldiers and equipment are protected. The frequent and rapid refueling operations carried out by the National Guard Aviation presents a high risk of fires occurring due to spilled fuel on and around the flight line. Current portable fire suppression systems used by the National Guard Aviation employ various known chemical agents to suppress the fire such as $CO_2$, Halon gas, and Dry Chemical (Purple K).

A typical $CO_2$ system uses 25 lbs. of $CO_2$ and has a shooting range of 45 feet for a duration of about 45 seconds. The problem most often encountered with those systems to suppress a fire is that the $CO_2$ discharge is easily diffused by the wind, thus adversely affecting the intensity and direction of the $CO_2$ spray. Also, $CO_2$ systems do not provide flashback protection and the fire can be easily re-ignited if there is fuel remaining.

Halon gas systems suppress fire by removing the oxygen from the fire, thus extinguishing the fire by removing the oxidizer required for fire to burn. Typical Halon gas systems have a discharge range of approximately 50 feet for a duration of 90 seconds. As with the $CO_2$ systems, Halon systems do not provide flashback protection. Another disadvantage of Halon systems is that Halon is not environmentally friendly as it destroys the earth's ozone layer, and thus cannot be released into the air at any time other than for actual fire suppression. This limitation prevents actual field training for use of the system. Also, Halon systems are mandated for replacement by the year 2003.

The typical Dry Chemical (Purple K) system has a range of 25 feet for a duration of 51 seconds. The disadvantages of such systems are that they do not provide flashback protection, are only fairly stable in windy conditions, are easily effected by age and humidity, and are difficult to service.

There are also foam expansion systems currently available. Such foam expansion systems produce "high energy" foam by injecting compressed air at ambient temperature into a water-foam concentrate solution to generate a volume of foam much greater than the volume of water. Conventional foam expansion systems generally use two different approaches to generate foam. One approach is to use an air aspirating nozzle and make the foam at the nozzle point. However, the use of ambient temperature air results in ambient temperature foam being produced. Another approach is to use a mixing manifold to combine compressed air with the solution upstream of the nozzle; however, such conventional systems introduce air in direction of flow that is perpendicular to the flow of solution. This approach adversely affects foam expansion and acceleration because the air does not negotiate right angle turns efficiently. The result is diminished foam expansion ratios and discharge distances. And, neither conventional system provides the capability to control or vary the moisture content of the foam produced for a specific application.

Accordingly, there is a need for a need for a portable cold foam producing fire suppression system for flammable liquid and structure fires, that has an extended discharge range and duration, that provides flashback protection, and that allows operator training using chemicals that are environmentally safe. The present invention satisfies this need, as well as others, and generally corrects the deficiencies found in the background art.

BRIEF SUMMARY OF THE INVENTION

The present invention pertains to a portable fire suppression system that serves as the first line of defense for fire suppression and can be immediately available to the user at the site of the hazard. The system can extinguish a fire in a matter of seconds by shooting a blanket of cold foam over the fire. Flashback or re-ignition potential of the fire is nullified due to the foam blanket sealing off flammable vapors as the foam emulsifies with petroleum on contact. The cold foam produced and discharged clings to all potential fuel surfaces—horizontal, vertical, inverted-providing heat reflection and insulation, and fuel isolation and wetting. Once applied, the cold foam keeps the fire hazard too damp to burn. The system has a foam discharge distance of 80–100 feet, which places the operator at a safe distance from the hazard. Even gusty winds of 25–30 knots do not affect the coverage of the foam over the fire.

By way of example and not limitation, the portable fire suppression system of the present invention comprises a foam expansion manifold, an on/off charge valve, a solution tank, a pressure-regulated compressed air supply system, check valves, associated piping and tubing, and a frame assembly.

The foam expansion manifold receives a chemical solution from the solution tank through the solution inlet port and cold compressed air through the air injection port, mixes both together in the mixing chamber causing a "supercharging" effect by expanding the solution into a fire suppressing foam and accelerating the foam through the foam outlet port. The solution entering the mixing chamber forms foam that expands up to forty times as a result of mixing with cold compressed air, however, the system is conservatively rated at twenty times foam expansion. The cold compressed air is injected into the foam expansion manifold in the same general flow direction as the solution entering the chamber, but at an angle relative to the direction of solution entering into the mixing chamber that has been determined to the optimal angle to cause both a maximum expansion of the solution into cold foam and to accelerate the foam from the outlet port at a desirable rate.

The air supply system provides built-in redundancy as it comprises two air tanks. Only one tank is required to operate the air system at any given time, with the other tank serving a back-up in the event of failure or air supply exhaustion of the other tank. There is a pressure regulator for each tank, thus providing independent control capability and ensuring that air from one tank does not bleed through to the other tank. The air supply exiting the regulator is split to the solution tank and to the foam expansion manifold. Check valves prevent backflow from the solution tank and/or the expansion manifold from entering the regulators or air supply tanks. The use of a compressed air supply eliminates the need for air compressors which cannot provide the air volume capability and causes the system to be unacceptably large, heavy, inefficient, noisy and expensive.

The solution tank stores the chemical that mixes with water to form a solution which is then mixed with air to expand into the fire suppressing foam. Cold compressed air from the air tanks pressurizes the solution tank and sends the solution contained therein to the foam expansion manifold where the solution is mixed with cold air causing an expansion and acceleration of the foam from the expansion manifold. The solution can be recharged within minutes in the field by first filling the tank with the foam chemical, then filling the tank with water.

The components of the system are mounted on a tubular metal frame that is rugged and compact. The frame is properly balanced and is strong enough to withstand vertical impacts when the unit is parachuted out into remote sites. The frame has a hitch to provide for an attachment point for a sling load of a helicopter. Casters on the frame allow easier mobility of the unit at its use location.

An object of the invention is to provide a portable fire suppression apparatus which serves as a first line of defense for fire suppression.

Another object of the invention is to provide a portable fire suppression apparatus which produces an environmentally safe fire suppressing cold foam from a mixture of cold air and chemical solution.

Yet another object of the invention is to provide a portable fire suppression apparatus capable of shooting fire suppressing foam a distance of 80–100 feet, thus allowing the operator to maintain a safe distance from the hazard.

Yet another object of the invention is to provide a portable fire suppression apparatus which allows the operator to control the moisture content of the fire suppressing foam.

Yet another object of the invention is to provide a portable fire suppression apparatus with a redundant air supply system.

Yet another object of the invention is to provide a portable fire suppression apparatus housed in a very compact frame capable of withstanding vertical impacts from drops via parachute.

A final object of the invention is to provide a portable fire suppression apparatus which permits use of dish soaps during training exercises.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
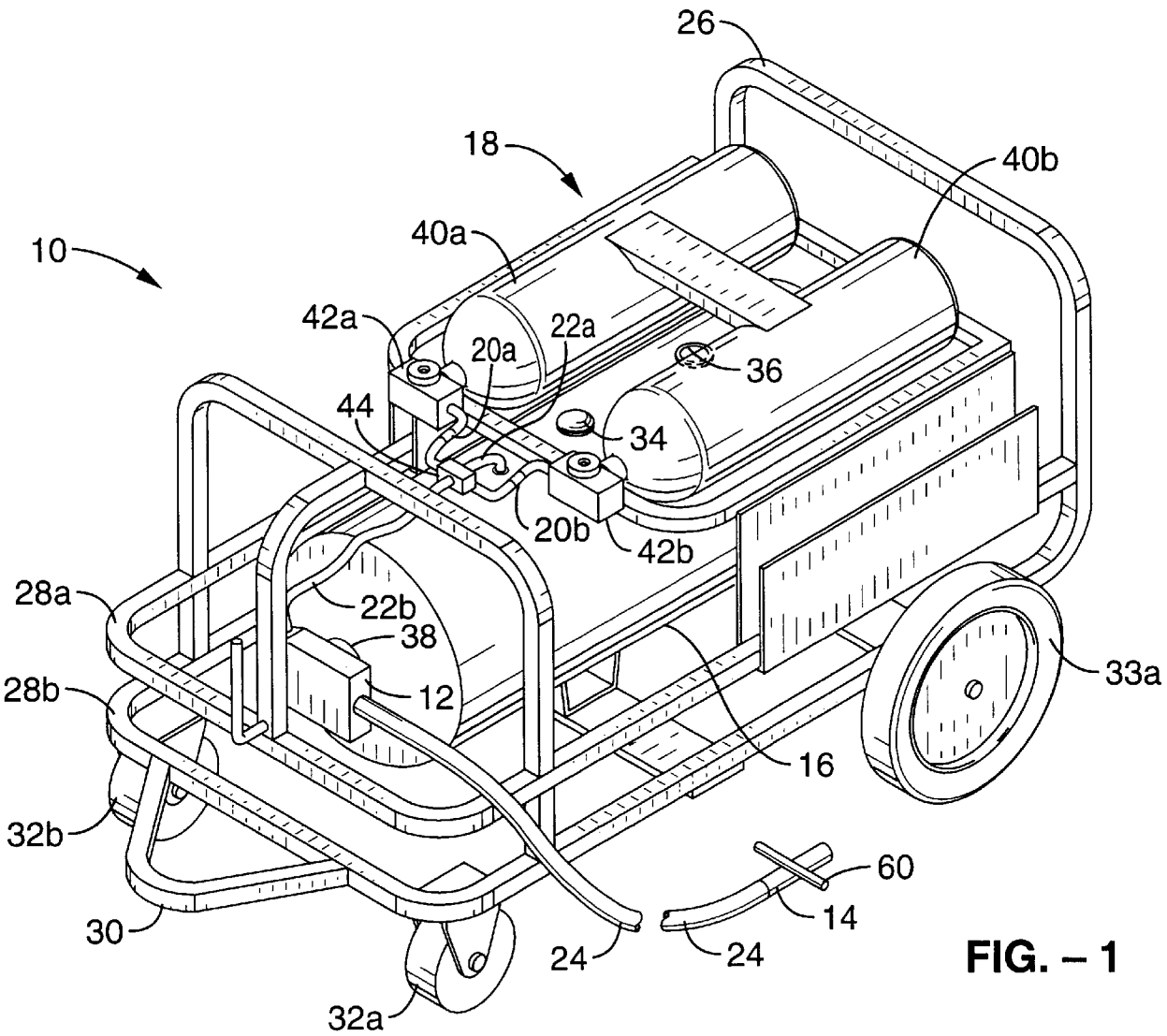
FIG. 1 is a perspective view of a cold compressed air fire suppression apparatus in accordance with the present invention.
Figure 2:
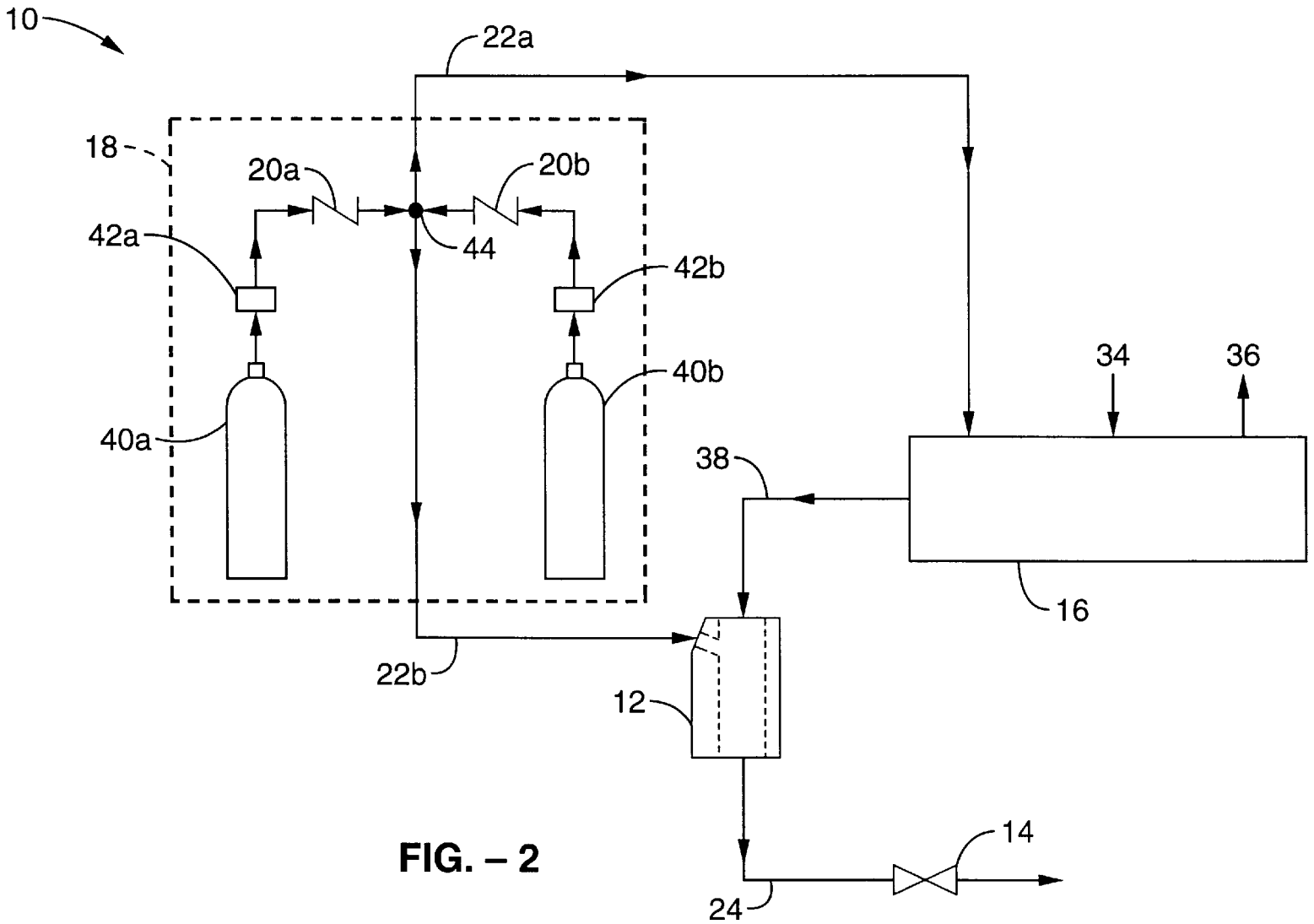
FIG. 2 is a functional schematic diagram of the apparatus shown in FIG. 1.
Figure 3:
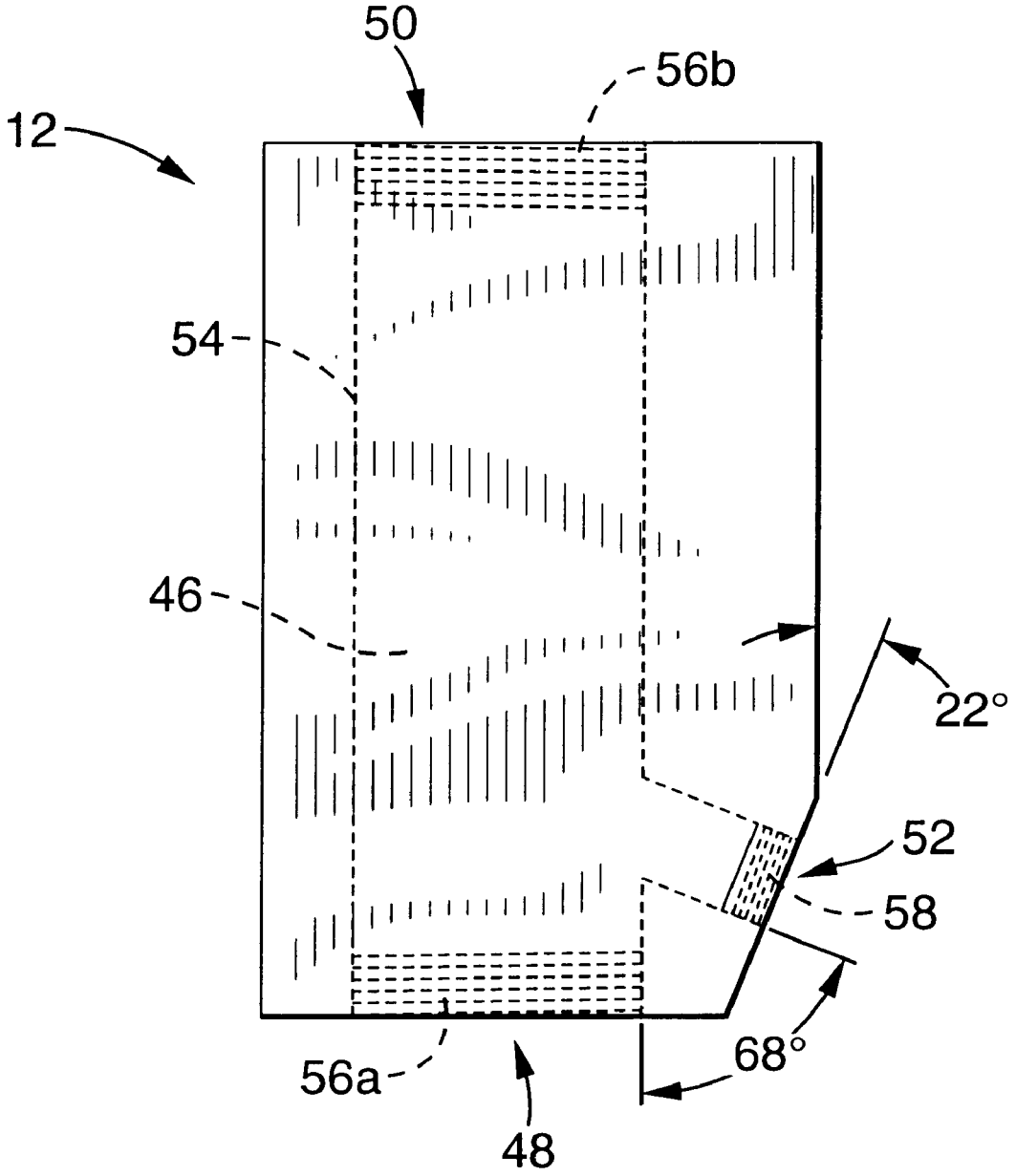
FIG. 3 is a top plan view of the foam expansion manifold portion of the apparatus shown in FIG. 1 and FIG. 2.

Referring more specifically to the drawings, for illustrative purposes the present invention is embodied in the apparatus generally shown in FIG. 1 through FIG. 3. It will be appreciated that the apparatus may vary as to configuration and as to details of the parts without departing from the basic concepts as disclosed herein.

Referring first to FIG. 1 and FIG. 2, the present invention a cold compressed air foam fire suppression apparatus 10 in accordance with the present invention is generally shown. As will be seen, the apparatus 10 comprises a foam expansion manifold 12, an on/off charge valve 14, a solution tank 16, a pressure-regulated air supply system 18, a pair of check valves 20*a* and 20*b*, associated tubing 22*a* and 22*b*, a discharge hose 24 and a frame assembly 26. Air supply system 18 provides a source of regulated compressed air preferably at a discharge pressure of approximately 155 psi to solution tank 16 and foam expansion manifold 12. The regulated compressed air enters solution tank 16, pressurizes a solution contained therein, and sends the solution to foam expansion manifold 12. The regulated air also enters foam expansion manifold 12 where it mixes with the pressurized solution coming from solution tank 16. Check valves 20*a* and 20*b* within air supply system 18 prevent any solution from foam expansion manifold 12 from backing-up and entering air supply system 18. This mixture of air and solution causes a desired foam to form and expand and accelerate out foam expansion manifold 12. The foam exits the system 10 through foam expansion manifold 12 and is controlled by charge valve 14 located on discharge hose 24.

All the components of fire suppression system 10 are mounted on a metal frame assembly 26. Frame assembly 26 is preferably fabricated from rigid, lightweight 1¼ inch square metal tubing or the like. Solution tank 16 is mounted between a pair of frame rails 28*a* and 28*b*, and air supply system 18 is affixed above solution tank 16 in a parallel orientation relative to solution tank 16. A hitch 30 is mounted on the frame along with front castors 32*a* and 32*b* and rear castors 33*a* and 33*b* (not shown). All the plumbing components within the system are of hydraulic-quality parts or the like.

Solution tank 16 stores a mixture of chemical and water which, when combined with high pressure air, forms a fire suppressing foam. The chemical used can be Aqueous Film Forming Foam, Clean Agent Foam, common dish soap or like environmentally safe chemical. On the top of solution tank 16 is a water/chemical fill port 34 that has a hose adapter to allow filling solution tank 16 with water. Water/chemical fill port 34 also allows chemicals to be added to solution tank 16. The chemical is typically added to solution tank 16 first, followed by adding water to solution tank 16. When water is added to solution tank 16 and begins mixing with the chemical, a solution is formed. This process of forming the solution is commonly referred to as batch mixing, and forming the solution in this manner eliminates the need for chemical proportioner, thus assuring that any imbalance caused by a malfunctioning proportioner unit will not have a derogatory effect on operation of the invention. A vent valve 36 is located on top of solution tank 16 to allow the release of air pressure prior to refilling solution tank 16 with the chemical and water. A pipe, hose or other like coupling 38 is located at the forward end of the solution tank 16 to provide a fluid coupling between foam expansion manifold 12 and solution tank 16.

Air supply system 18 preferably comprises a pair of air tanks 40*a*, 40*b*, a pair of corresponding pressure regulators 42*a*, 42*b* located downstream of air tanks 40*a*, 40*b*, a pair of corresponding check valves 20*a*, 20*b* located downstream of pressure regulators 42*a*, 42*b*, and a junction connector 44. Air tanks 40*a*, 40*b* are standard underwater dive tanks and store cold compressed air (ideally −20° F. to −30° F.) at approximately 3000 psi. Air tanks 40*a*, 40*b* supply the pressurized air required for the system 10 to function; however, preferably only one air tank operates at any given moment to supply pressurized air to the system 10. This dual air tank configuration provides redundancy to the system in the event of air supply exhaustion or a malfunction of the other air tank. Pressure regulators 42*a*, 42*b* are of the standard scuba diving type and regulate the compressed cold air supply down to a pressure of approximately 155 psi. The operator can switch air sources, for example, by shutting off the regulator 42*a* located downstream of air tank 40*a* and opening the regulator 42*b* downstream of air tank 40*b*. The air exiting either regulator 42*a* or 42*b* (or both if desired) is sent to a junction connector 44 which routes some of the air to the solution tank through the tubing 22*a*. Check valves 20*a*, 20*b* located between regulators 42*a*, 42*b* and the solution tank 16 prevent the backflow of air or solution into air tanks 40*a*, 40*b* and regulators 42*a*, 42*b*. Junction connector 44 routes the remaining air through the tubing 22*b* to the foam expansion manifold 12.

Referring also to FIG. 3, foam expansion manifold 12, which is fabricated from an aluminum or high strength polymer block or the like, includes a mixing chamber 46 having an inlet port 48, an outlet port 50 and an air injection port 52. Mixing chamber 46 essentially comprises a longitudinal bore 54 with internal threads 56*a*, 56*b* at the input and output ends, respectively. Inlet port 48 receives solution from the solution tank 16 and directs the solution into the mixing chamber 46. Air injection port 52 receives compressed air from air supply 18 and injects the air into the mixing chamber 46 at an optimum 68° relative to the path in which the solution enters mixing chamber 46, or 22° relative to a line perpendicular to the longitudinal axis of mixing chamber 46. The mixture of air and solution in the mixing chamber 46 causes a "supercharging" effect that accelerates the flow and causes the solution to expand to form a fire suppressing foam. Up to a 40:1 solution-to-foam expansion occurs in the mixing chamber 46, although the invention is conservatively rated for a 20:1 expansion. The foam accelerates out of foam expansion manifold 12 through outlet port 50. Note that air injection port 52 includes internal threads 58. Internal threads 56*a* on inlet port 48 and internal threads 56*b* on outlet port 50 allow connection to tubing 22*a*, 22*b*, respectively, and internal threads 58 on air injection port 52 allow connection to coupling 38 between air injection port 52 and solution tank 16.

In the preferred embodiment of the invention, air injection port 52 has an optimum inside diameter of ⅜ inch. Varying the inside diameter of air injection port 52 varies the density of the foam produced in mixing chamber 46. If the inside diameter of the air injection port 52 is increased above ⅜ inch, the volume of air increases but the pressure drops. This results in a drier foam that does not shoot as far. If the inside diameter of the air injection port 52 is decreased below ⅜ inch, the pressure increases but the volume of air decreases. This results in a wetter foam which shoots further that with a larger diameter. Also, longitudinal bore 54 in mixing chamber 46 has an optimum inside diameter of 1 inch. Varying the inside diameter of the longitudinal bore 54 of mixing chamber 46 also varies the density of the foam produced. If a larger inside diameter is used, the volume increases, but less air mixes to dry the foam. This results in a wetter foam that will shoot further but which empties solution tank 16 sooner. If a smaller inside diameter is used, the volume decreases and more air is used to dry the foam. The result is a drier foam which will not shoot as far due to the lower water weight as water is required to carry the foam, however the solution tank 16 depletes at a slower rate.

Charge valve 14 is located on discharge hose 24 opposite the end that is connected to outlet port 50 of foam expansion manifold 12. Charge valve 14 controls the delivery of the foam exiting the apparatus 10. Charge valve 14 is preferably a ¾ inch ball valve or the like equipped with a handle 60. Charge valve 14 allows varying the moisture content of the foam produced by the foam expansion manifold 12. The best foam is produced when charge valve 14 is wide open. In this condition, and with the pressures and other parameters of foam expansion manifold 12 described above, approximately 1¾ minutes of cold foam (approximately 600 gallons) can be produced from a 30 gallon solution tank. The moisture content (wetness) of the foam can be controlled by charge valve 14. If charge valve 14 is partially closed, the bubbles break up, decreasing the volume of foam and making the foam wetter. Wetter foams are best for deep 20 seated fires in upholstery, etc. where it is desirable for the foam to penetrate the surface. Drier foams are used for fires where it is desirable to make a foam blanket to insulate, isolate and seal off vapors. This takes air away from the fire and will quickly cause the fire to extinguish.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A foam expansion manifold for a portable cold foam producing fire suppression apparatus, comprising:

(a) a mixing chamber, said mixing chamber including a first end and a second end;

(b) a liquid solution inlet port located at said first end, said inlet port configured for directing a flow of liquid solution into said mixing chamber, said inlet port further configured for receiving a pressurized solution of liquid from a storage vessel;

(c) a foam outlet port located at said second end; and (d) a cold compressed air injection port located adjacent said first end, said compressed air injection port configured for directing cold compressed air into said mixing chamber, said compressed air injection port further configured for receiving cold compressed air from a cold compressed air supply;

(e) wherein said mixing chamber is configured for mixing said compressed air and said pressurized liquid solution to produce cold foam which exits said foam outlet port.

2. A portable foam producing fire suppression apparatus, comprising:

(a) a foam expansion manifold, said foam expansion manifold including a mixing chamber, said mixing chamber including a first end and a second end, said foam expansion manifold including a liquid solution inlet port, said liquid solution inlet port located at said first end of said mixing chamber, said liquid solution inlet port configured for directing a flow of liquid solution into said mixing chamber, said mixing chamber including a foam outlet port located at said second end of said mixing chamber, said mixing chamber including a cold compressed air injection port located adjacent said first end of said mixing chamber, said cold compressed air injection port configured for directing cold compressed air into said mixing chamber;

(b) a solution storage vessel coupled to said solution inlet port; and (c) a cold compressed air supply system in fluid connection with said solution storage vessel and said compressed air injection port.

3. An apparatus as recited in claim 2, further comprising flow control means for controlling the flow rate of foam from said foam expansion manifold.

4. An apparatus as recited in claim 3, wherein said flow control means comprises a charge valve, said charge valve downstream of said foam outlet port.

5. An apparatus as recited in claim 2, further comprising moisture varying means to vary the moisture content of foam produced by said apparatus.

6. An apparatus as recited in claim 5, wherein said moisture varying means comprises a charge valve, said charge valve in fluid connection with said foam outlet port.

7. An apparatus according to claim 2, wherein the compressed air supply presents compressed air to the mixing chamber at a temperature ranging between −30° F. to −20° F.

8. A portable foam producing fire suppression apparatus, comprising:

(a) a foam expansion manifold, said foam expansion manifold including a mixing chamber capable of receiving liquid solution therethrough, said foam expansion manifold capable of mixing cold compressed air directed at said liquid solution at an angle relative to the direction of flow of liquid solution through said mixing chamber;

(b) a liquid solution storage vessel fluidically coupled to said foam expansion manifold;

(c) flow control means for controlling the rate of foam flow from said foam expansion manifold;

(d) a cold compressed air supply system in fluid connection with said liquid solution vessel and said foam expansion manifold, said cold compressed air supply system comprising:

(i) a plurality of air tanks in parallel connection, said air tanks storing compressed air;

(ii) a plurality of regulators, each said regulator controlling each said air tank;

(iii) a plurality of check valves, each said check valve located downstream each said regulator; and (iv) a junction connector in fluid connection with said check valves, said solution storage vessel and said foam expansion manifold, said junction connector capable of distributing air from said air tanks to said solution storage vessel and said foam expansion manifold.

9. An apparatus as recited in claim 8, wherein said foam expansion manifold comprises:

(a) a mixing chamber, said mixing chamber including a first end and a second end;

(b) a solution inlet port, said solution inlet port located at said first end, said inlet port directing flow of solution into said mixing chamber;

(c) a foam outlet port, said outlet port located at said second end; and (d) an air injection port, said air injection port located adjacent said first end, said air injection port angled to allow compressed air into said mixing chamber at an acute angle relative to the flow of solution into said mixing chamber.

10. An apparatus as recited in 8, wherein said flow control means comprises a charge valve fluidically coupled to said foam expansion manifold.

11. An apparatus as recited in claim 8, further comprising moisture varying means to vary the moisture content of foam produced by said apparatus.

12. An apparatus as recited in claim 11, wherein said moisture varying means comprises a charge valve fluidically coupled to said foam expansion manifold.

13. A portable foam producing fire suppression apparatus, comprising:

(a) a foam expansion manifold, said foam expansion manifold including a mixing chamber, said mixing chamber including a first end and a second end, said foam expansion manifold including a liquid solution inlet port, said liquid solution inlet port located at said first end of said mixing chamber, said liquid solution inlet port configured for directing a flow of liquid solution into said mixing chamber, said mixing chamber including a foam outlet port, said foam outlet port located at said second end of said mixing chamber, said mixing chamber including a cold compressed air injection port located adjacent said first end of said mixing chamber, said cold compressed air injection port angled to allow compressed air into said mixing chamber;

(b) a liquid solution storage vessel fluidically coupled to said solution inlet port of said foam expansion manifold;

(c) means for varying flow rate and moisture content of foam from said foam expansion manifold; and (d) a cold compressed air supply system fluidically coupled to said solution storage vessel and to said compressed air injection port of said foam expansion manifold, said cold compressed air supply system comprising:

(i) a plurality of compressed air tanks;

(ii) a plurality of regulators, each said regulator controlling output pressure of a said one of said air tanks;

(iii) a plurality of check valves, each said check valve located downstream of a said one of said regulators; and (iv) a junction connector, said junction connector fluidically coupled to said check valves, said solution storage vessel and said air injection port of said foam expansion manifold, said junction connector distributing air from said air tanks to said solution storage vessel and said air injection port.

14. An apparatus as recited in claim 13, wherein said means for controlling the flow rate and moisture content of foam from said foam expansion manifold comprises a charge valve fluidically coupled to said outlet port of said foam expansion manifold.

* * * * *